US007950756B2

(12) United States Patent
Collins et al.

(10) Patent No.: US 7,950,756 B2
(45) Date of Patent: May 31, 2011

(54) DROP-DOWN SHELF

(75) Inventors: Bryan A. Collins, Williamston, SC (US); Richard B. Moulder, Anderson, SC (US); Christopher W. Baum, Piedmont, SC (US); Paul H. Kelly, Anderson, SC (US)

(73) Assignee: Electrolux Home products, Inc., Cleveland, OH (US)

( * ) Notice: Subject to any disclaimer, the term of this patent is extended or adjusted under 35 U.S.C. 154(b) by 845 days.

(21) Appl. No.: 11/845,959

(22) Filed: Aug. 28, 2007

(65) Prior Publication Data

US 2009/0058247 A1 Mar. 5, 2009

(51) Int. Cl.
*F25D 11/02* (2006.01)

(52) U.S. Cl. ..... 312/408; 312/248

(58) Field of Classification Search ..... 312/408, 312/404, 325, 247, 248, 116, 208.1, 321; 108/106–108, 145, 94–96, 99; 62/440, 441; 211/90.02, 90.03
See application file for complete search history.

(56) References Cited

U.S. PATENT DOCUMENTS 1,247,367 A * 11/1917 Burchell ..... 312/204
2,284,339 A * 5/1942 Nauert ..... 312/323
2,744,805 A * 5/1956 McMahan ..... 312/27
2,855,262 A 10/1958 Sharpe
3,352,431 A 11/1967 Smith
4,528,825 A 7/1985 Khan
4,775,201 A 10/1988 Thomson
D365,732 S 1/1996 Kellen et al.
D475,374 S 6/2003 Segers
6,997,531 B2 2/2006 Kim et al.
7,063,219 B2 6/2006 Fann et al.
2004/0135481 A1 7/2004 Diebold et al.
2004/0195945 A1* 10/2004 Farber et al. ..... 312/408
2004/0207305 A1 10/2004 Kim et al.
2005/0179351 A1 8/2005 Bassi
2005/0223731 A1 10/2005 Saeki et al.
2006/0097613 A1 5/2006 Lee et al.
2006/0125362 A1 6/2006 Kim

FOREIGN PATENT DOCUMENTS

JP 2007155250 * 6/2007

* cited by examiner

*Primary Examiner* — Janet M Wilkens
(74) *Attorney, Agent, or Firm* — Pearne & Gordon LLP

(57) ABSTRACT

Storage systems are provided with a first shelf and a drop-down shelf. In one example, the storage system includes first and second link members that are each slidably and pivotably attached with respect to the first shelf. Each of the link members is also pivotably attached with respect to the drop-down shelf. In another example, the storage system includes first and second stationary track guides that each extend away from the first shelf. The drop-down shelf includes first and second support structures that are each slidably received in a respective one of the stationary track guides.

27 Claims, 9 Drawing Sheets

DROP-DOWN SHELF

FIELD OF THE INVENTION

The present invention relates generally to storage systems that can provide a range of storage configurations. More particularly, the present invention relates to a drop-down shelf that is movable between multiple positions.

BACKGROUND OF THE INVENTION

Refrigerators are known to include a plurality of shelves for storing various items. Conventional shelves are beneficial to accommodate stored items such as large pizza boxes, wine bottles and/or other food or beverage containers. However, it may be difficult to move known shelves between multiple positions to accommodate a variety of storage configurations.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a storage system includes a first shelf and a drop-down shelf configured to be moved with respect to the first shelf. The storage system further includes a first link member slidably and pivotably attached with respect to the first shelf. The first link member is pivotably attached with respect to the drop-down shelf. The storage system further includes a second link member spaced from the first link member and slidably and pivotably attached with respect to the first shelf. The second link member is pivotably attached with respect to the drop-down shelf.

In accordance with another aspect of the present invention, a storage system comprises a first shelf, a first stationary track guide and a second stationary track guide. Each guide extends away from the first shelf. The storage system further includes a drop-down shelf with a first support structure and a second support structure spaced along a length of the drop-down shelf. The first support structure is slidably received in the first stationary track guide and the second support structure is slidably received in the second stationary track guide such that the drop-down shelf is configured to be selectively positioned in one of a plurality of alternative positions with respect to the first shelf.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
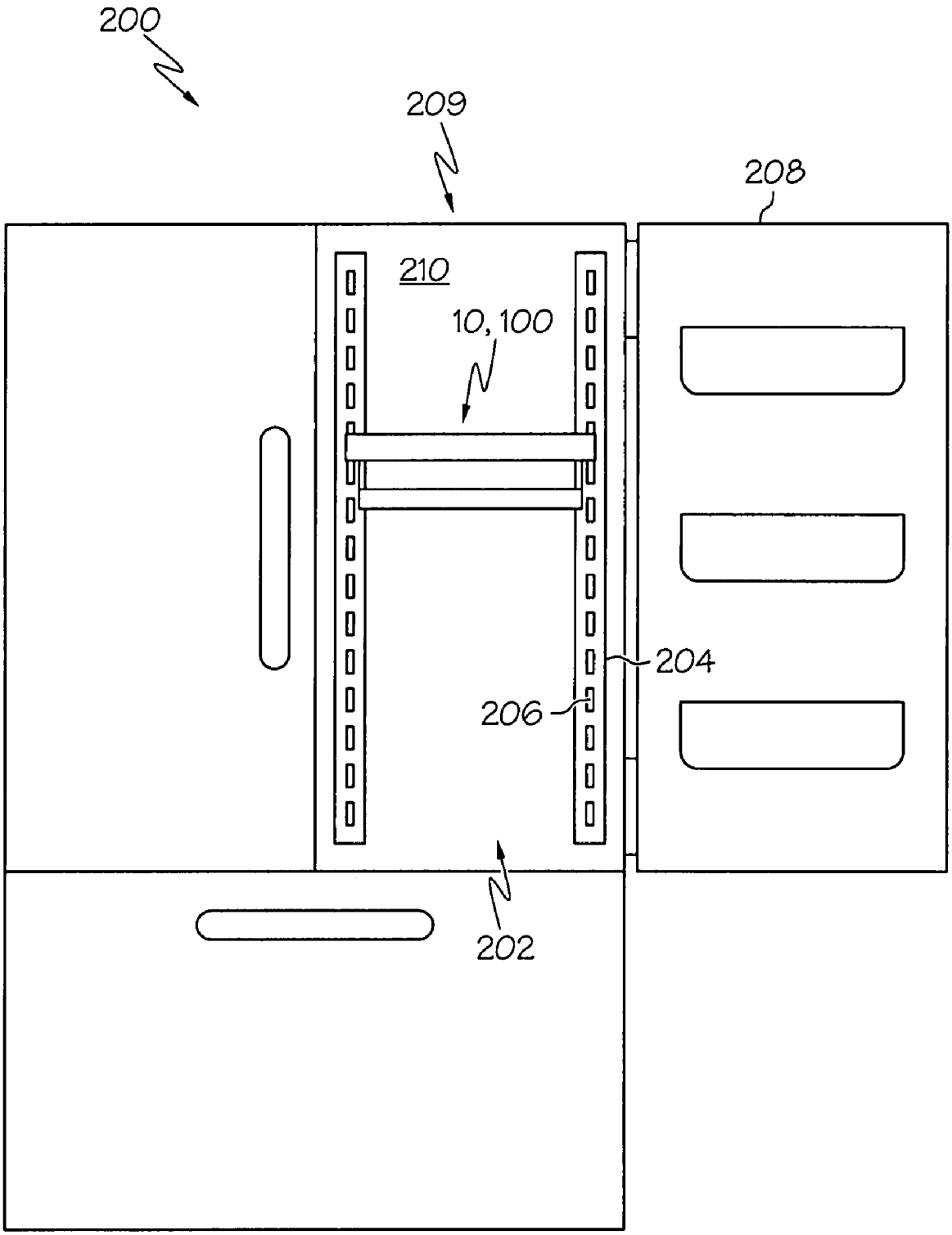
FIG. 1 is a schematic view of a refrigerator including a schematic depiction of example storage systems in accordance with aspects of the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

It is to be appreciated that the storage systems 10, 100 of any example embodiment can be used in different types of cabinets including storage systems for appliances, such as refrigeration appliances, dishwashers, ovens, or other appliance types. For instance, the storage systems 10, 100 of any example embodiment can be used in storage systems for refrigeration appliances such as refrigerator/freezer units, stand-alone refrigerators, stand alone freezers, or the like. For example, FIG. 1 depicts a schematic view of a refrigerator 200 including a schematic depiction of example storage systems 10, 100 in accordance with aspects of the present invention. In one example, the refrigerator 200 can include a cabinet 209 with at least one wall 210 defining an interior area 202. A refrigerator door 208 can be opened to provide access to the one or more of the example storage systems 10, 100. Moreover, it is contemplated the storage systems can include at least one hanger member configured to be attached with respect to the wall 210 of the cabinet 209 to support the first shelf within the interior area 202 of the cabinet 209. In one example, one or both of the hanger members 16A, 16B, 116A, 116B can include an interlocking device 212 configured to be attached with respect to the wall 210 at a selected elevation with the hanger members acting as a cantilever support for the first shelf. In the illustrated embodiment, a plurality of adjustment rails 204 are provided with vertically disposed apertures 206 to allow interaction with the interlocking device 212 to provide maintenance of the interlocking device 212 at the desired elevation within the interior area 202 of the cabinet 209.

FIGS. 2-5 and 5A illustrate example aspects of the storage system 10. The storage system 10 includes a first shelf 12 and a drop-down shelf 14. The first shelf 12 and the drop-down shelf 14 can have various shapes and dimensions. The first shelf 12 can include a first support surface 57 to support various objects for storage. The drop-down shelf 14 can include a second support surface 58 to support various objects for storage. The first support surface 57 and/or the second support surface 58 can include a transparent material for supporting objects and also for viewing the objects on the drop-down shelf 14. The first support surface 57 and the second support surface 58 of the drop-down shelf 14 can be made of plastic, glass, wire, or any other suitable rigid material. The first support surface 57 can be identical to the second support surface 58 although other configurations may be provided. For example, the first support surface 57 is shown as a substantially continuous flat transparent support surface.

The second support surface 58 can be identical to the first support surface 57 or may have other configurations. For example, as shown the drop-down shelf 14 can include at least one oval slot such as the illustrated plurality of oval slots 60. The one or more oval slots 60 can be configured to laterally support a beverage bottle, such as one or more wine bottles or other shaped objects. The oval slots can have a dimension that is smaller than the outer dimension of the container. Thus, the slot can be designed to support the bottle with respect to the shelf while inhibiting lateral rolling of the beverage bottle on the shelf.

Figure 4:
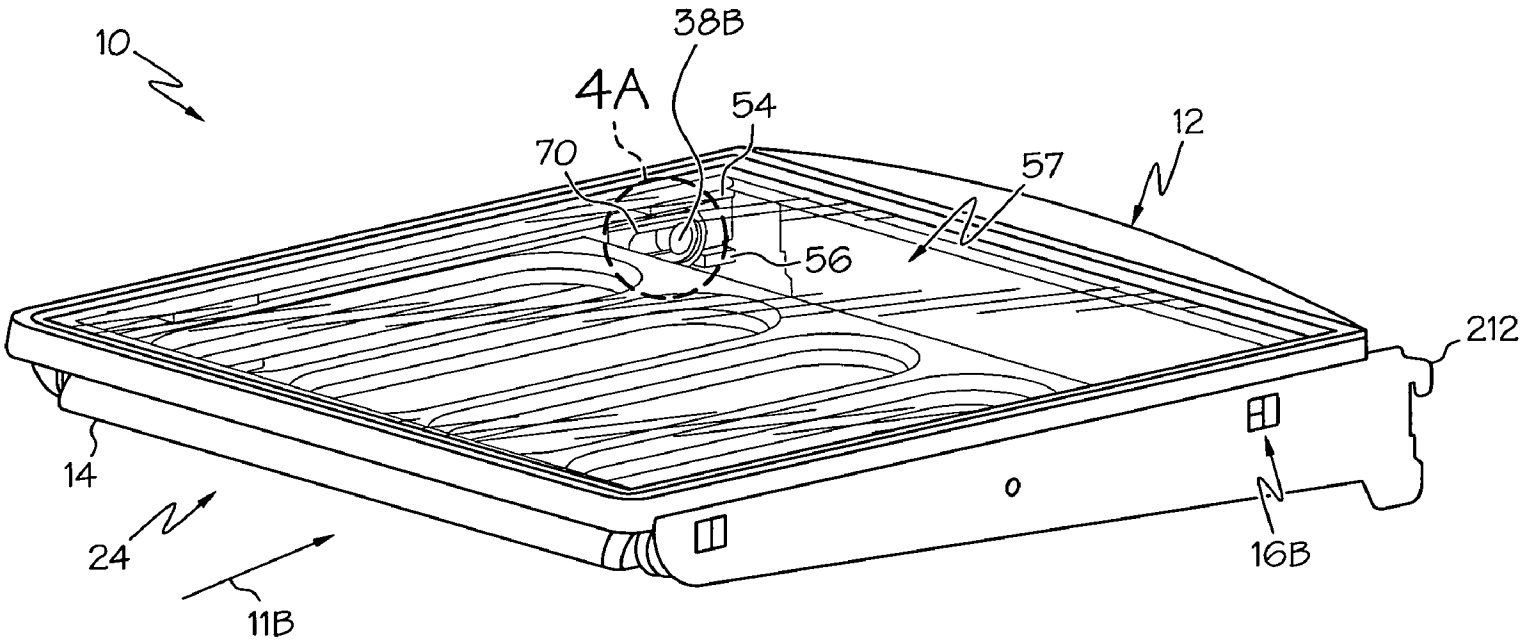
FIG. 4 is a perspective front view of the example storage system in the collapsed position.

The first support surface 57 and the second support surface 58 are substantially parallel to one another in the example embodiment shown in the deployed position 22 (FIG. 2) and in the collapsed position 24 (FIG. 4). In other examples, the first support surface 57 and the second support surface 58 can be placed at varying angles with respect to each other. In many of the examples, as the drop-down shelf 14 is moved between the deployed position 22 and the collapsed position 24, the angle between first support surface 57 and the second support surface 58 remains substantially constant with respect to one another as the drop-down shelf pivots with respect to the first shelf 12 between the deployed position 22 and the collapsed position 24.

A first hanger member 16A can be provided to support the first shelf 12. The first hanger member 16A can have varying shapes and dimensions so as to fully support the first shelf 12. The first hanger member 16A can be comprised of any rigid material such as plastic or metallic objects, though it is appreciated that other materials, shapes, and sizes can be used. The first hanger member 16A can support one or more sides of the first shelf 12. In addition or alternatively, a second hanger member 16B can also be provided, as shown in FIGS. 2-5. In this example, the second hanger member 16B supports a second side of the first shelf 12 and the first hanger member 16A supports a first side of the first shelf 12. Each hanger member 16A, 16B can be separate from the first shelf 12. One or more of the hanger members 16A, 16B can also be formed as a unitary structure with the first shelf 12 and/or the sidewalls of an interior area 202 of a cabinet 209 of a refrigerator 200, or other appliance. In further examples, the hanger members 16A, 16B can be attached to the outer edges of the frame 18 of the first shelf 12. One example of such an attachment is by providing a snap-in feature between the hanger members 16A, 16B and the frame 18 of the first shelf 12. Another example of attachment is to provide an aperture for a fastener 17 to be inserted, where the aperture can be located on either the frame 18 of the first shelf 12 or the hanger members 16A, 16B. A combination of attachment means can also be employed. Alternatively, the hanger members 16A, 16B can be in engagement with the inner edges of the frame 18 of the first shelf 12, or even to both the inner and outer edges of the frame 18. The hanger members 16A, 16B can also be attached to the first shelf 12 by a combination of different structures. It is to be appreciated that the hanger members 16A, 16B are not limited to the illustrated orientation with respect to the first shelf 12 and that one or more hanger members 16A, 16B can be used in any of the examples.

Figure 4A:
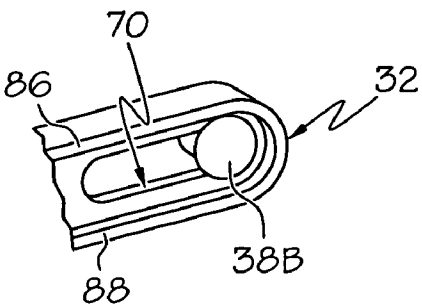
FIG. 4A is an enlarged view of portions of the storage system taken at view 4A of FIG. 4.
Figure 5:
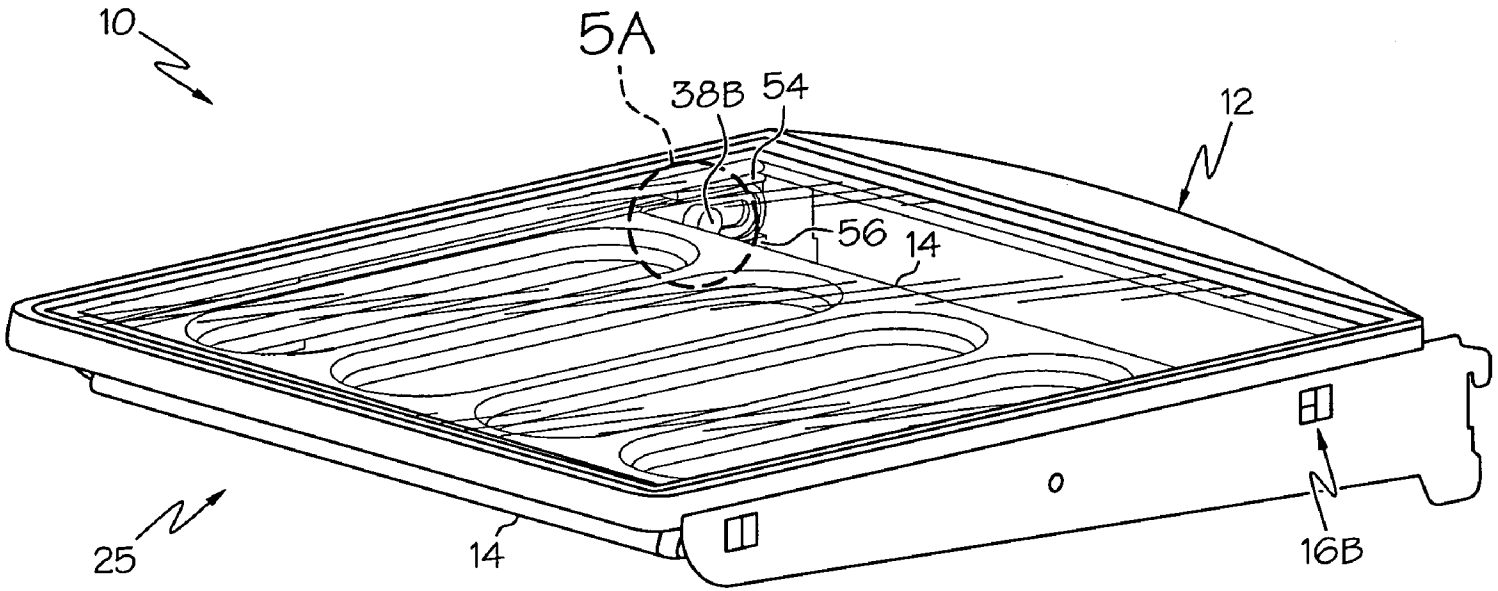
FIG. 5 is a perspective front view of the example storage system in a locked position.
Figure 5A:
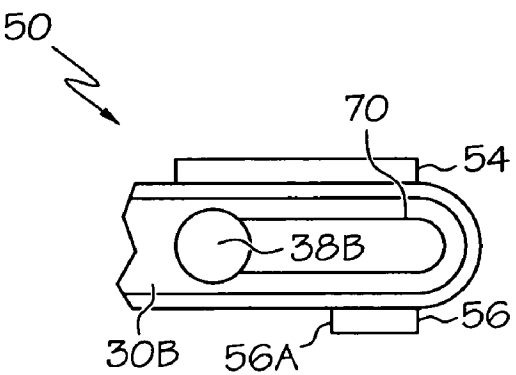
FIG. 5A is an enlarged side view of portions of the storage system taken at view 5A of FIG. 5.

A plurality of link members can be used to attach the first shelf 12 to the drop-down shelf 14. In the illustrated example, four link members 30A, 30B, 30C, 30D are provided although more or less link members may be provided in further examples. The illustrated link members 30A, 30B, 30C, 30D are identical to one another, although different configurations may be provided in further examples. In one example, as seen in FIG. 4A, the link members 30A, 30B, 30C, 30D can include one or more optional flanges 86, 88 to help strengthen the link members 30A, 30B, 30C, 30D.

At least one of the link members 30A, 30B, 30C, 30D can be slidably and pivotably attached with respect to the first shelf 12. In one example, the link members can be slidably and pivotably attached directly to the first shelf 12. As shown, the link members 30A, 30B, 30C, 30D can be slidably and pivotably attached with respect to the first shelf 12 by way of the hanger members 16A, 16B. For example, as shown, each link member 30A, 30B, 30C, 30D includes a first end 32 that is slidably and pivotably attached to a corresponding support structure of the hanger members 16A, 16B.

At least one of the link members can be pivotably attached with respect to the drop-down shelf 14. As shown, the link members can be pivotally attached directly to the drop-down shelf 14 although it is contemplated that one or more of the link members may be indirectly attached to the drop-down shelf in further examples. Moreover, in further examples, as shown, each of the link members 30A, 30B, 30C, 30D can be pivotally and non-slidably attached with respect to the drop-down shelf 14.

In one example, the first hanger member 16A includes a first support structure 38A and a second support structure 38B spaced along a length of the first hanger member 16A. Similar or identical support structures can be provided for the second hanger member 16B. The support structures can comprise a wide variety of mechanical structures with many different dimensions and orientations. In the illustrated example, the mechanical structures comprise protrusions that extend from each hanger member 16A, 16B.

The drop-down shelf 14 also can include a first side 15A and a second side 15B with a width extending between the first side 15A and the second side 15B. The first side 15A of the drop-down shelf 14 can include a pair of support structures (not shown). Likewise, the second side 15B of the drop-down shelf 14 can also include the illustrated first support structure 36A and the second support structure 36B of the drop-down shelf 14. The pair of support structures of the first side 15A of the drop-down shelf 14 cannot be seen in the current example in FIG. 2, but it is appreciated that the pair of support structures can be similar or identical to the first support structure 36A and the second support structure 36B of the second side 15B of the drop-down shelf 14.

Various structures can be provided to achieve the slidably and pivotable attachment of the link members with respect to the first shelf and the pivotable attachment of the link members with respect to the drop-down shelf. For instance, in the illustrated example, the first end 32 of each of the link members 30A, 30B, 30C, 30D can include an elongated slot 70 configured to receive a corresponding support structure 38A, 38B, such as the illustrated protrusions, of the hanger members 16A, 16B. Each protrusion can be received in a corresponding elongated slot 70 of each link member 30A, 30B, 30C, 30D for slidably and pivotably attaching each link member 30A, 30B, 30C, 30D to the corresponding hanger member 16A, 16B. For example, as shown, the first end 32 of the first link member 30A includes an elongated slot 70 that slidably and pivotably receives the first support structure 38A (e.g., protrusion) of the first hanger member 16A. Likewise, the first end 32 of the second link member 30B can include an identical elongated slot that slidably and pivotably receives the second support structure 38B (e.g., protrusion) of the first hanger member 16A. If a second hanger member 16B is provided, a similar configuration may be employed. It is appreciated that the elongated slots 70 can be located along the same or different positions of each link member 30A, 30B, 30C, 30D and can have varying shapes and dimensions.

Figure 2:
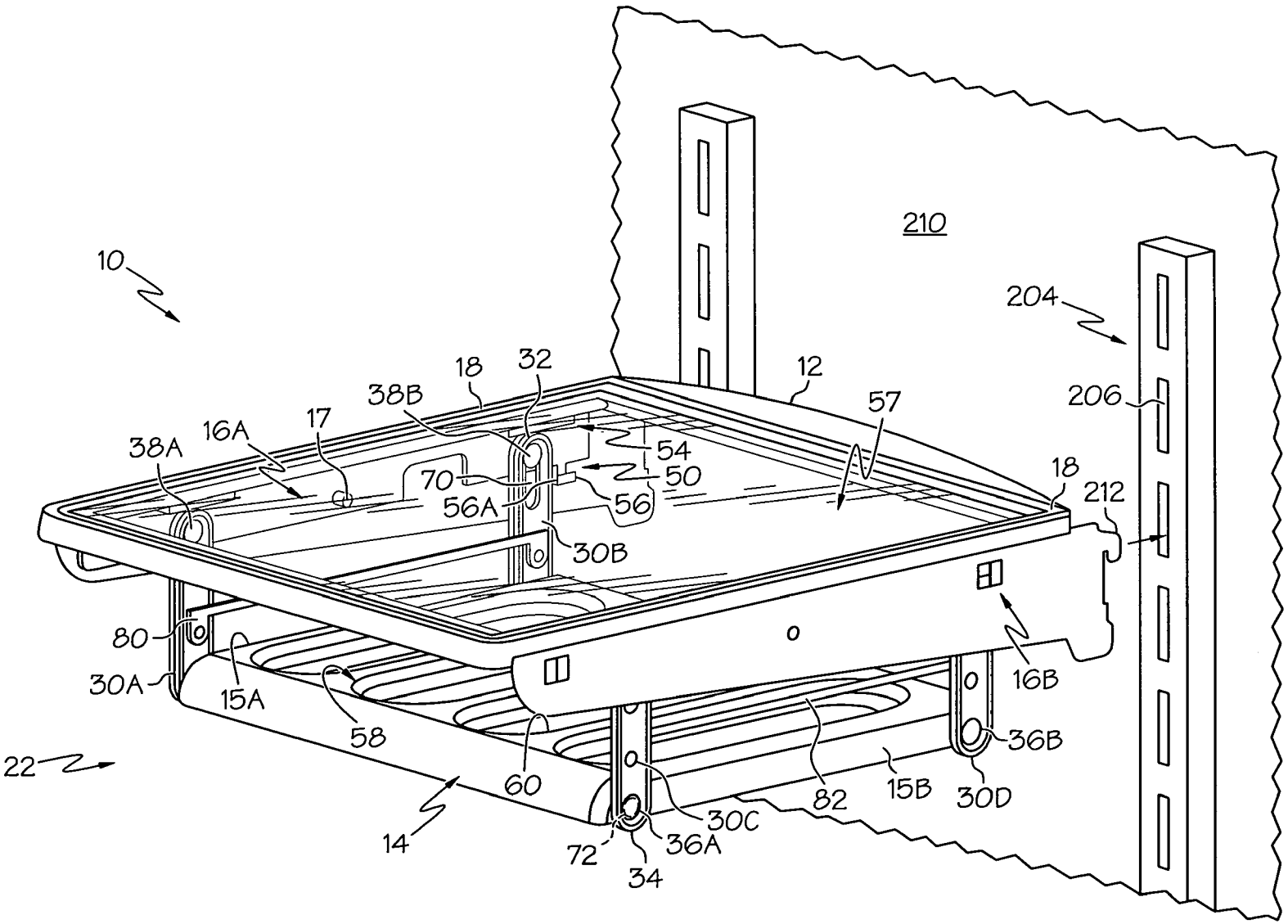
FIG. 2 is a perspective front view of an example storage system in a deployed position.
Figure 3:
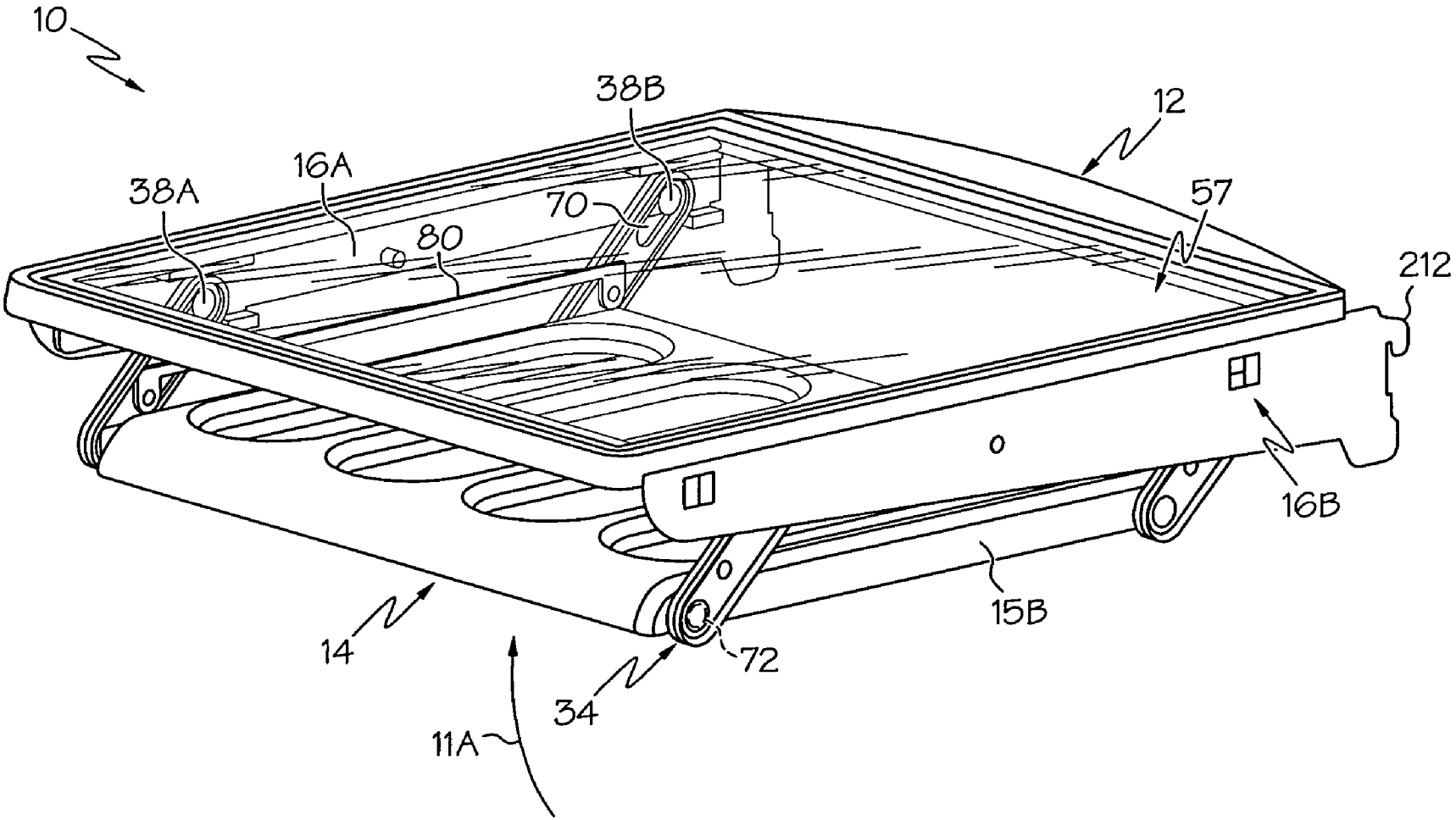
FIG. 3 is a perspective front view of the example storage system in a position between the deployed position and a collapsed position.

The second hanger member 16B can also be provided with third and fourth link members 30C, 30D that appear as mirror images of the first and second link members 30A, 30B as shown in FIG. 2. It will be understood, therefore, that the first end of the third link member 30C includes an elongated slot that slidably and pivotably receives the first support structure (e.g., protrusion) of the second hanger member 16B. Likewise, the first end 32 of the fourth link member 30D can include an identical elongated slot that slidably and pivotably receives the second support structure (e.g., protrusion) of the second hanger member 16B.

Each link member 30A, 30B, 30C, 30D can be pivotably attached to each corresponding support structure 36A, 36B of the drop-down shelf 14, as seen in FIG. 2. As further shown in the example, each link member may be non-slidably attached to each corresponding support structure of the drop-down shelf 14. Indeed, as illustrated, the second end 34 of each of the link members 30A, 30B, 30C, 30D can include an aperture 72 configured to pivotably receive corresponding support structures 36A, 36B (e.g., protrusions) extending from the drop-down shelf 14.

To provide additional stability for the storage system 10, an optional first brace 80 can be provided for engagement between the first link member 30A with the second link member 30B. Likewise, a second brace 82 can also be provided for engagement between the third link member 30C with the fourth link member 30D. Other arrangements and orientations of the hanger members 16A, 16B and link members 30A, 30B, 30C, 30D are also possible, with or without providing the braces 80, 82.

The elongated slots 70 of the link members 30A, 30B, 30C, 30D facilitate pivoting of the drop-down shelf 14 from a deployed position 22 (see FIG. 2), a collapsed position 24 (see FIG. 4). The elongated slots 70 further facilitate sliding of the drop-down shelf 14 from the collapsed position 24 (see FIG. 4) to a locked position 25 (see FIG. 5). For example, in the deployed position 22, the first end 32 of each line member 30A, 30B, 30C, 30D is designed to abut a first flange member 54 to prevent sliding movement of the link members 30A, 30B, 30C, 30D with respect to the first shelf 12. However, the links are free to rotate such that the drop-down shelf 14 can rotate in direction 11A from the deployed position 22 to the collapsed position 24. Once in the collapsed position 24, the link can slide along linear direction 11B to be straddled between the first flange member 54 and a second flange member 56. The first and second flange member 54, 56 can therefore act as one example of a lock structure 50 configured to inhibit pivoting between the first shelf 12 and the drop down shelf 14 in the locked position 25.

The lock structure 50 can be located on at least one of the plurality of hanger members 16A, 16B or the first shelf 12. In the example of FIG. 2, the lock structure 50 includes a plurality of flanges 54, 56 although other lock structures may be used in further examples. The first flange 54 can provide an additional guide and can aid in stabilizing the link members 30A, 30B, 30C, 30D. The first flange 54 can further inhibit the link members 30A, 30B, 30C, 30D from pivoting with respect to the first shelf 12 when the drop-down shelf 14 is placed in a locked position 25. The first flange 54 can also act as an abutment surface for the corresponding link member to encourage primary pivoting movement of the link member when pivoting the drop-down shelf from the deployed position to the collapsed position. The second flange 56 can also aid in stabilizing the link members 30A, 30B, 30C, 30D when the drop-down shelf 14 is in the locked position 25. Still further, as shown in FIG. 2, the second flange 56 can include an abutment edge 56A to act as a stop against the link member 30B, thereby preventing over pivoting of the link to limit movement of the drop-down shelf at the deployed position. Lock structures can comprise a wide variety of configurations and functionalities. For instance, the lock structure, if provided, can limit the drop-down shelf 14 in any three-dimensional direction, and can include interlocking elements, magnetic elements or other configurations designed to limit movement of the link members.

To redeploy the drop-down shelf 14, a user can pull the drop-down shelf 14 outward from the locked position 25 to the collapsed position 24. Once the links are clear of the lock structure 50, the user can then pivot the drop-down shelf down from the collapsed position 24 to the deployed position 22.

The plurality of support structures 36A, 36B of the drop-down shelf 14 and the plurality of support structures 38A, 38B of the hanger members 16A, 16B can include snap-in features for facilitating assembly of the system. Other shapes and dimensions can be used in further examples.

Figures 6, 6A:
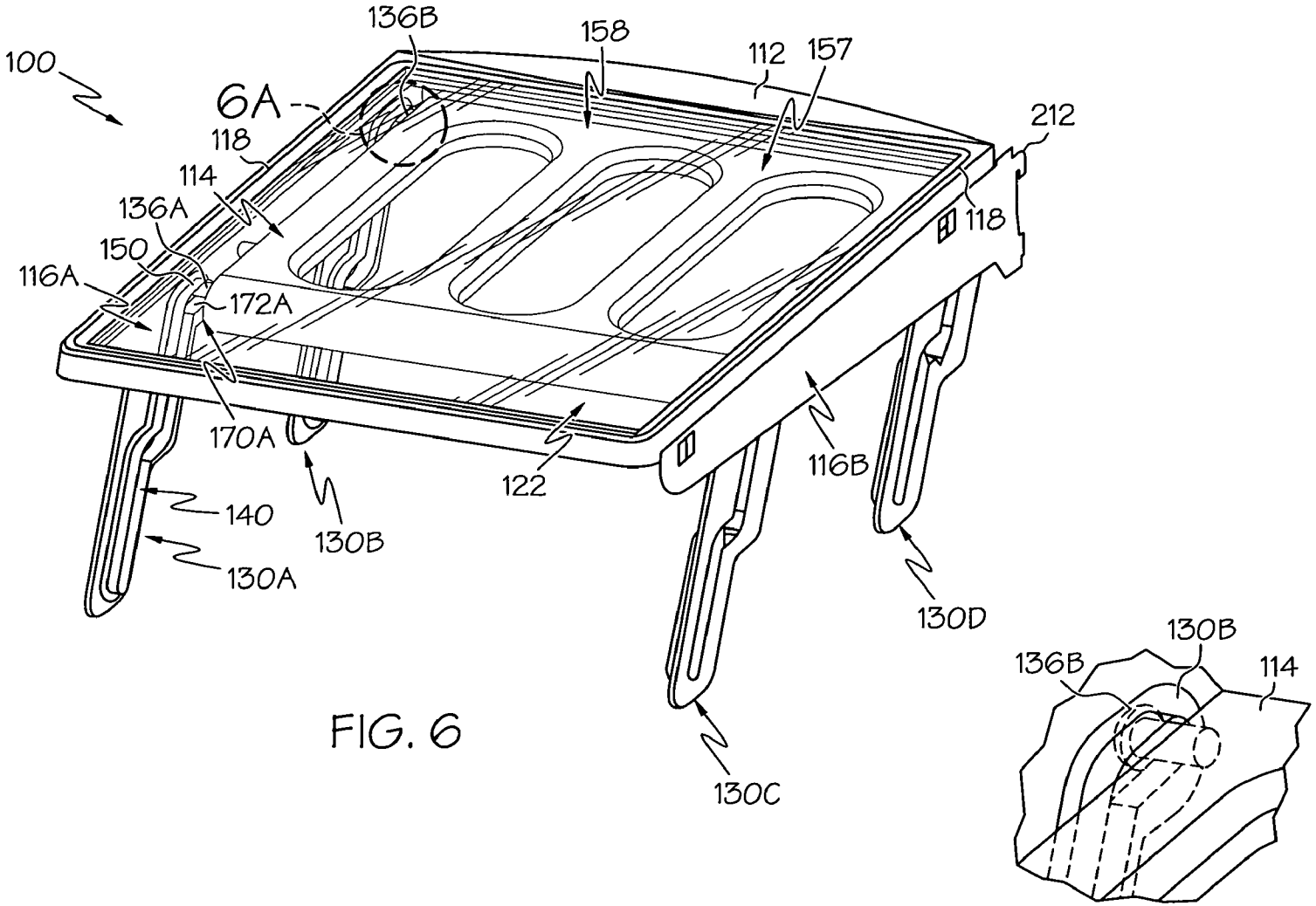
FIG. 6 is a perspective front view of a second example storage system with a drop-down shelf in a first position.
FIG. 6A is an enlarged view of portions of the second storage system taken at view 6A of FIG. 6.
Figure 7:
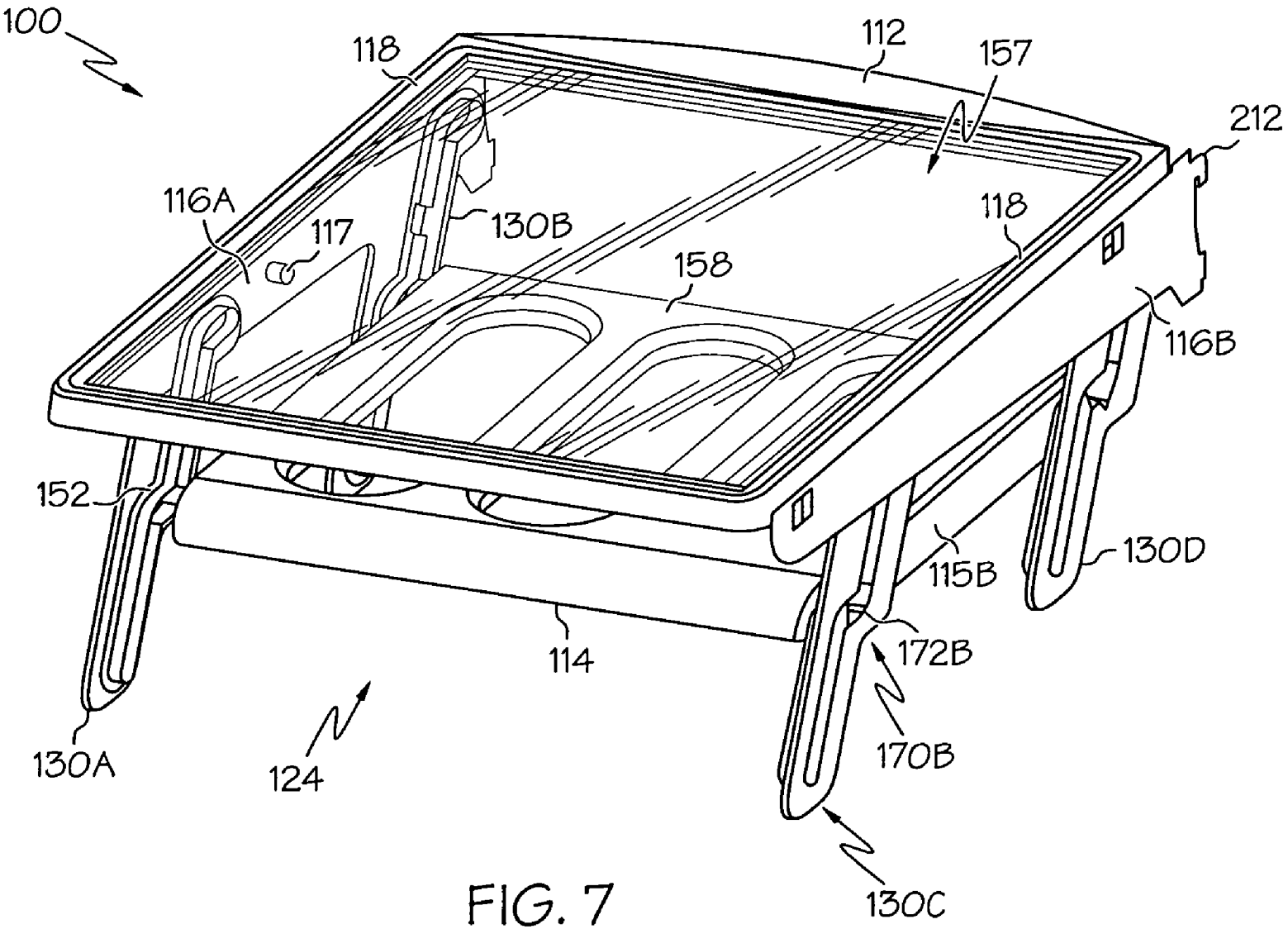
FIG. 7 is a perspective front view of the second example storage system with the drop-down shelf in a second position.
Figure 8:
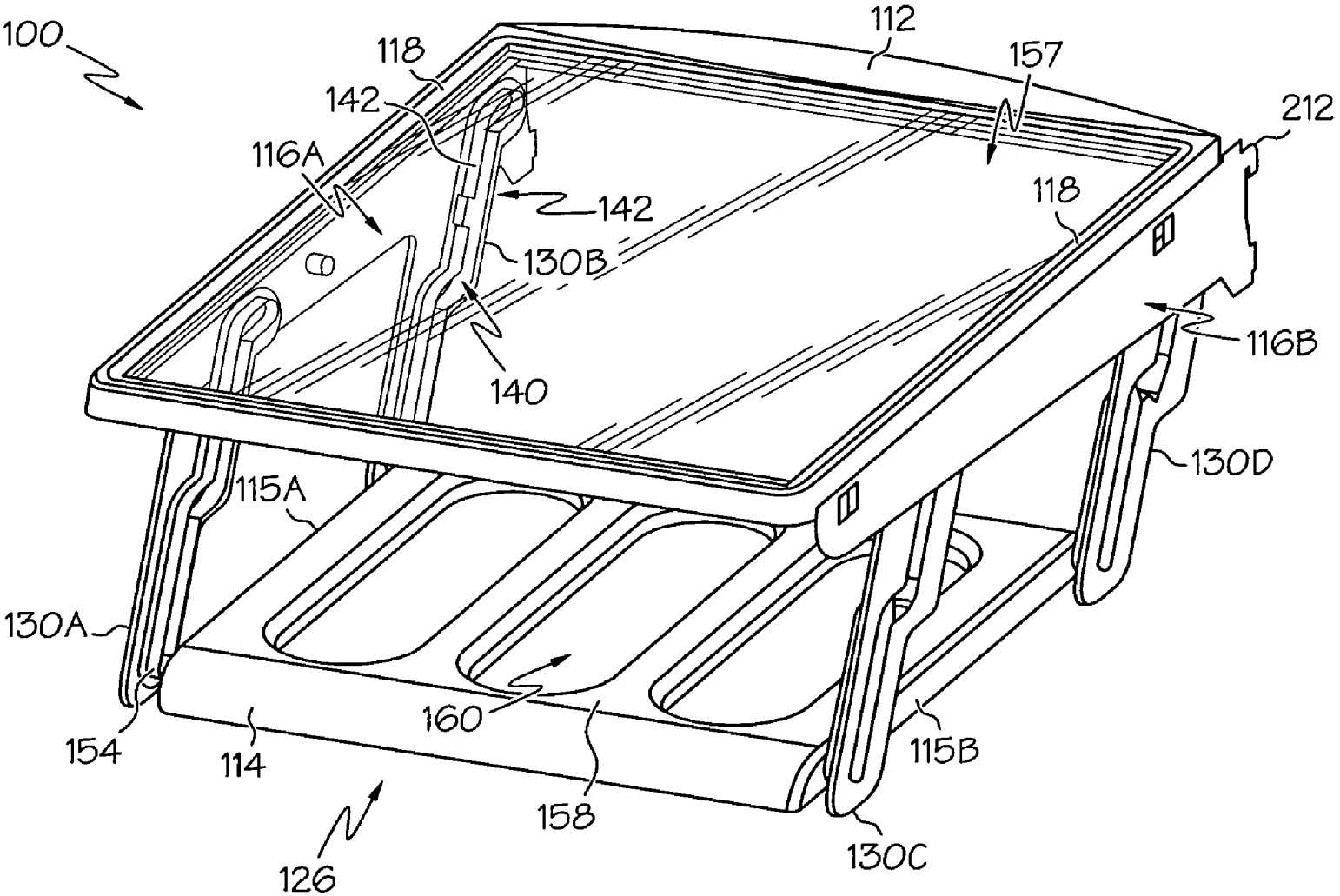
FIG. 8 is a perspective front view of the second example storage system with the drop-down shelf in a third position.

A second example embodiment of a storage system 100 is shown in FIGS. 6-9. The illustrated storage system 100 includes a first shelf 112 and a drop-down shelf 114. The first shelf 112 and the drop-down shelf 114 can have various shapes and dimensions as discussed with respect to the storage system 10 above. The drop-down shelf 114 moves between at least two positions although three or more positions are contemplated in further examples. In one example, as shown, the drop-down shelf 114 can move between three positions including a first position 122 (FIG. 6) and a second position 124 (FIG. 7) and a third position 126 (FIG. 8).

The first shelf 112 and the drop-down shelf 114 can have various shapes and dimensions. The first shelf 112 can include a first support surface 157 and the drop-down shelf 114 can include a second support surface 158 to support various objects for storage. Although nontransparent support surfaces are contemplated, the first support surface 157 and/or the second support surface 158 can include a transparent material for supporting objects and also for viewing the objects through one or more of the shelves. The first support surface 157 and/or the second support surface 158 of the drop-down shelf 114 can be made of plastic, glass, wire, or any other suitable support material. The first support surface 157 can be identical to the second support surface 158 although other configurations may be provided. For example, the first support surface 157 is shown as a substantially continuous flat transparent support surface.

The second support surface 158 can be identical to the first support surface 157 or may have other configurations. For example, as shown, the drop-down shelf 114 includes a plurality of oval slots 160 although a single oval slot 160 may be used in further examples. The oval slots 160 can be configured to laterally support a beverage bottle, such as one or more wine bottles or other shaped objects. The oval slots can have a dimension that is smaller than the outer dimension of the container. Thus, the slot can be designed to support the bottle with respect to the shelf while inhibiting lateral rolling of the beverage bottle on the shelf.

The first support surface 157 and the second support surface 158 can be substantially parallel to one another as shown in the first position 122 (FIG. 6), the second position 124 (FIG. 7) and the third position 126 (FIG. 8). In other examples, the first support surface 157 and the second support surface 158 can be placed at varying angles with respect to each other. In many of the examples, the angle between first support surface 157 and the second support surface 158 can remain substantially constant with respect to one another as the drop-down shelf 114 moves between the first, second and third positions.

As shown in FIGS. 6 and 6A, the drop-down shelf 114 includes a first support structure 136A and a second support structure 136B spaced along a length of the drop-down shelf 114. In another example, the drop-down shelf 114 can further include a first side 115A and a second side 115B with a width extending between the first side 115A and the second side 115B. The first side 115A can include a first and a second support structure 136A, 136B of the drop-down shelf 114. In the illustrated example, the second side 115B of the drop-down shelf 114 includes a third and a fourth support structure (not shown) that are substantially identical to the first and second support structure 136A, 136B. Each support structure can comprise a wide variety of mechanical structures with many different dimensions and orientations that are similar or different from one another. In the illustrated example, the mechanical structures comprise substantially identical protrusions that extend from a respective side of the drop-down shelf 114.

The storage system 100 further includes a first stationary track guide 130A and a second stationary track guide 130B that each extend away from the first shelf 112. The first support structure 136A of the drop-down shelf 114 is slidably received in the first stationary track guide 130A and the second support structure 136B of the drop-down shelf 114 is slidably received in the second stationary track guide 130B such that the drop-down shelf 114 is configured to be selectively positioned in one of a plurality of alternative positions with respect to the first shelf 112.

In another example, as shown, the storage system 100 can also include a third stationary track guide 130C and a fourth stationary track guide 130D that each extend away from the first shelf 112. It will be appreciated that the illustrated example includes a third support structure similar to the first support structure 136A and a fourth support structure similar to the second support structure 136B. In the illustrated example, the third support structure is slidably received in the third stationary track guide 130C and the fourth support structure is slidably received in the fourth stationary track guide 130D.

The stationary track guides 130A, 130B, 130C, 130D allow the drop-down shelf 114 to be selectively positioned in one of a plurality of alternative positions with respect to the first shelf 112. In the illustrated embodiment, the stationary track guides are configured to permit the drop-down shelf 114 to be selectively positioned in three different alternative positions, although two or more than three positions may be provided in further examples. The stationary track guides extend away from the first shelf 112. In one example, the stationary track guides extend vertically downward from the first shelf. As shown, the stationary track guides can also extend downward and forward although other configurations may be selected depending on the particular application. The illustrated track guides 130A, 130B, 130C, 130D can remain stationary with respect to the first shelf 112 during repositioning of the drop-down shelf 114. Thus, the operator is not required to adjust, pivot, or move the track guides 130A, 130B, 130C, 130D when moving the drop-down shelf 114 between alternative selected positions.

Figure 9:
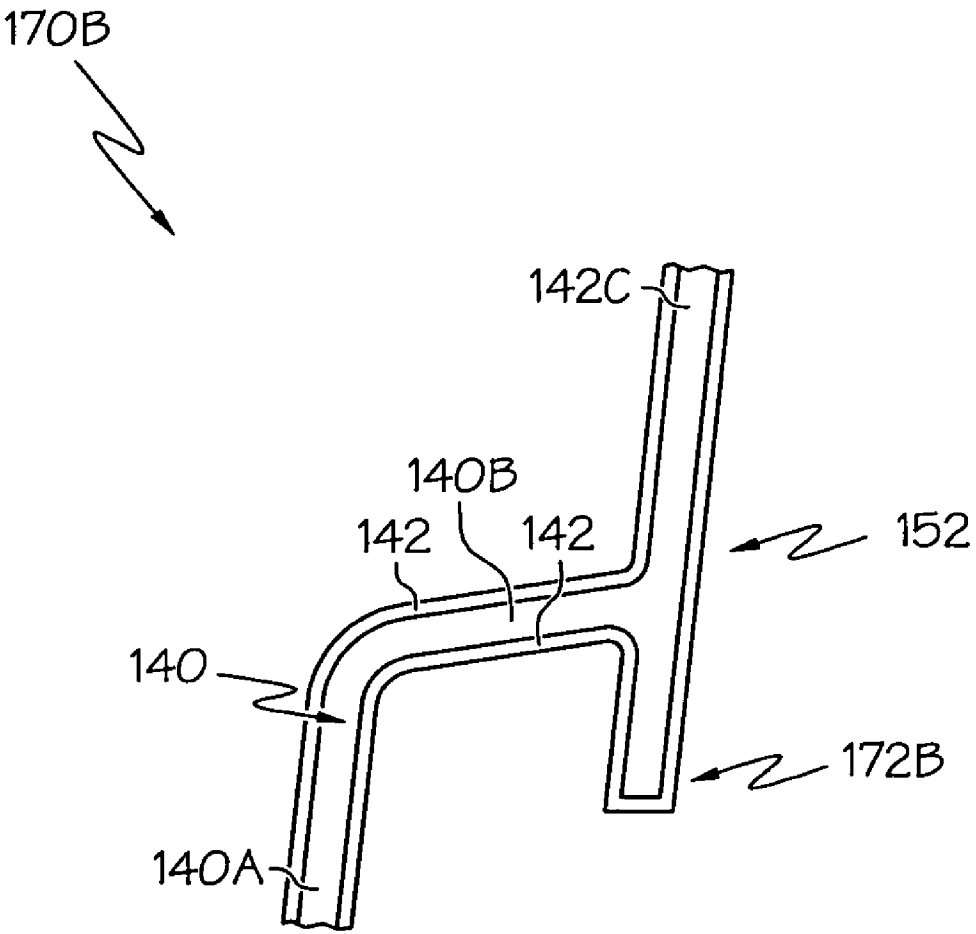
FIG. 9 depicts an example trap of an example stationary track guide.

The stationary track guides can have alternative configurations and structures to facilitate positioning of the drop-down shelves. As apparent in FIGS. 8 and 9, each of the stationary track guides 130A, 130B, 130C, 130D can include outer edges 142 that surround a guide path 140, for improving receipt of the support structures 136A, 136B by the corresponding track guides. The illustrated guide path 140 comprises a through slot although a groove or other structure may be used in further examples. Moreover, the support structures of the drop-down shelf 114 can have a shape that complements the shape of a guide path 140 of the track guides 130A, 130B, 130C, 130D (FIG. 9). For example, the support structures 136A, 136B can have a cylindrical shape, though other shapes may be utilized for receipt by the guide path 140. In other embodiments, the support structure 136A, 136B of the drop-down shelf 114 can also be snap-in features, similar to the support structures of the storage system 10 discussed above.

The sliding engagement between the support structures 136A, 136B of the drop-down shelf 114 and the guide path 140 of the respective stationary track guide 130A, 130B, 130C, 130D allows the drop-down shelf 114 to be moved between a plurality of positions based on the shape of the guide path 140. As seen in FIGS. 6-9, each guide path 140 can include an area corresponding to each drop-down shelf position. For example, as shown in FIG. 6, each guide path 140 can include a first area 150 configured to received a corresponding support structure of the drop-down shelf in the first position 122. As shown in FIG. 7, each guide path 140 can further include a second area 152 configured to receive a corresponding support structure of the drop-down shelf 114 in the second position 124. As further shown in FIG. 8, each guide path 140 can still further include a third area 154 configured to receive a corresponding support structure of the drop-down shelf in the third position 126.

In another example, the track guides 130A, 130B, 130C, 130D also can include at least one trap for assisting in maintenance of the drop-down shelf 114 in the desired position. As shown in FIG. 6, the first area 150 may include a first trap 170*a* to help maintain the drop-down shelf 114 in the first position 122. As further shown in FIG. 7, the second area 152 may include a second trap 170*b* to help maintain the drop-down shelf 114 in the second position 124. Example traps may include a protrusion, latch or other mechanism to facilitate maintenance of the drop-down shelf position. In one example, the first trap 170*a* includes a first recessed area 172*a* and the second trap 170*b* includes a similar recessed area 172*b*. FIG. 9 illustrates example features of the first recessed area 172*a* with the understanding that the second recessed area 172*b* may include similar and/or identical features. In the illustrated example, the second and third areas 152, 154 of all of the guide paths 140 include a respective trap 170*a*, 170*b* with a recessed area 172*a*, 172*b*. Each recessed area 172*a*, 172*b* can be configured to receive a respective support structure of the drop-down shelf 114 in the desired selected position. Furthermore, example traps may have further and/or alternative structures such as a protrusion, latch, interlocking elements, magnetic elements and/or other mechanism in further examples.

To adjust the position of the drop-down shelf 114 from the third position 126 (FIG. 8), to the second position 124 (FIG. 7), the user may lift the drop-down shelf 114. Referencing FIG. 9, the support structures 136A, 136B then vertically slide within a first portion 140*a* of each guide path 140. Once the support structures reach a second portion 140*b* of the guide path 140, the user may then push the drop-down shelf 114 backward until the support structures align with the second recessed area 172*b*. Gravity then causes the drop-down shelf to shift downward such that the support structures are seated within the second recessed area 172*b* to maintain the drop-down shelf 114 in the second position 126 (FIG. 7). To adjust the position of the drop-down shelf 114 from the second position 126 (FIG. 7) to the first position 122 (FIG. 6), the user may lift the drop-down shelf 114. Referencing FIG. 9, the support structures 136A, 136B then vertically slide within a third portion 140*c* of the guide path 140. Once the support structures reach the first area 150 of the guide path 140, the user may then push the drop-down shelf 114 backward until the support structures align with the first recessed area 172*a*. Gravity then causes the drop-down shelf to shift downward such that the support structures are seated within the first recessed area 172*a* to maintain the drop-down shelf 114 in the first position 122 (FIG. 6).

In another example, the storage system 100 can include a first hanger member 116A configured to support the first shelf 112. In one example, the first and second stationary track guides 130A, 130B can be attached to the first hanger member 116A although it is contemplated that the first and second stationary track guides 130A, 130B may be attached to the first shelf 112 in further examples. The first hanger member 116A can have varying shapes and dimensions to partially or fully support the first shelf 112. The first hanger member 116A can support one or more sides of the first shelf 112.

In further examples, the storage system can include two or more hanger members. For instance, as shown, the storage system 100 includes a second hanger member 116B in addition to the first hanger member 116A. In such an example, the first hanger member 116A can be designed to support a first side of the first shelf 112 and the second hanger member 116B can be designed to support a second side of the first shelf 112. In further examples, the third and fourth stationary track guides 130C, 130D, if provided, may be attached to the second hanger member 116B although it is contemplated that the third and fourth stationary track guides 130C, 130D may be attached to the first shelf 112 in further examples.

Although not shown, the hanger members may be integrally connected to the wall 210 of an interior area 202 of a cabinet 209 of a refrigerator 200 or other appliance. In addition or alternatively, each hanger member can be separate or integrally formed with the first shelf 112. For example, the hanger members 116A, 116B can be attached to the outer edges of the frame 118 of the first shelf 112. Such an attachment can be provided by a snap-in feature between the hanger members 116A, 116B and the frame 118 of the first shelf 112. Another example of attachment is to provide by a fastener 117 extending through an aperture of the hanger member and corresponding aperture located first shelf 112 such as the frame 118 of the first shelf. It is to be appreciated that the hanger members 116A, 116B are not limited to any one position with respect to the first shelf 112 and that the hanger members 116A, 116B can have varying dimensions. The hanger members 116A, 116B can be comprised of any rigid material such as plastic or metallic objects, though it is appreciated that other materials, shapes, and sizes can be used.

In any of the examples, the drop-down shelf 114 can be moved generally upwardly or downwardly in relation to the first shelf 112 until a plurality of support structures 136A, 136B on the drop-down shelf 114 reaches one of a plurality of areas 150, 152, 154. Each area 150, 152, 154 of the guide paths 140 are configured to support the drop-down shelf 114. As discussed above, for example, the first area 150 can be provided with a first trap 170*a* and the second area 152 can be provided with a second trap 170*b* configured to respectively maintain the drop-down shelf 114 in the first and second positions. It is contemplated that the third area 154 can simply comprise an end of the guide path 140 since the drop-down shelf 114 is in the lowest possible position with no possibility of falling to a lower position.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A storage system comprising:

a first shelf;

a drop-down shelf configured to be moved with respect to the first shelf;

a first link member slidably and pivotably attached with respect to the first shelf, and wherein the first link member is pivotably attached with respect to the drop-down shelf;

a second link member spaced from the first link member and slidably and pivotably attached with respect to the first shelf, and wherein the second link member is pivotably attached with respect to the drop-down shelf; and a lock structure configured to inhibit pivoting of the drop-down shelf in a deployed position by engaging the second link member.

2. The storage system of claim 1, wherein the first and second link members are configured to permit the drop-down shelf to pivot with respect to the first shelf between the deployed position and a collapsed position.

3. The storage system of claim 2, wherein the first and second link members are further configured to permit the drop-down shelf to translate with respect to the first shelf between the collapsed position and a locked position.

4. The storage system of claim 3, wherein the lock structure is configured to inhibit pivoting between the first shelf and the drop-down shelf in the locked position.

5. The storage system of claim 4, wherein the lock structure includes protrusions straddling a portion of the first link member in the locked position.

6. The storage system of claim 2, wherein the first shelf includes a first support surface and the drop-down shelf includes a second support surface, wherein an angle between the first and second support surfaces is configured to remain substantially constant as the drop-down shelf pivots with respect to the first shelf between the deployed position and the collapsed position.

7. The storage system of claim 6, wherein the first support surface and the second support surface are configured to remain substantially parallel with respect to one another as the drop-down shelf pivots with respect to the first shelf between the deployed position and the collapsed position.

8. The storage system of claim 2, wherein a front portion between the first shelf and the drop-down shelf is configured to be open, such that in the deployed position and in a position between the deployed position and the collapsed position, the drop-down shelf is configured to receive items through the front portion.

9. The storage system of claim 1, wherein the first shelf includes a first side and a second side with a width extending between the first and second sides and the drop-down shelf includes a first side and a second side with a width extending between the first and second sides, wherein the first and second link members are each pivotably attached with respect to the first side of the drop-down shelf and wherein the first and second link members are each slidably and pivotably attached with respect to the first side of the first shelf.

10. The storage system of claim 9, further comprising a third link member and a fourth link member spaced from the third link member, wherein the third and fourth link members are each pivotably attached with respect to the second side of the drop-down shelf and wherein the third and fourth link members are each slidably and pivotably attached with respect to the second side of the first shelf.

11. The storage system according to claim 1, further comprising a brace pivotally attached between the first and second link members.

12. The storage system according to claim 1, wherein the first link member is non-slidably attached with respect to the drop-down shelf.

13. The storage system according to claim 12, wherein the second link member is non-slidably attached with respect to the drop-down shelf.

14. The storage system of claim 1, further comprising a first hanger member configured to support the first shelf, wherein the first link member is slidably and pivotably attached to the first hanger member.

15. The storage system of claim 14, wherein the first link member includes an elongated slot configured to slidably and pivotably receive a first support structure of the first hanger member.

16. The storage system of claim 14, wherein the second link member includes an elongated slot configured to slidably and pivotably receive a second support structure of the first hanger member.

17. The storage system of claim 14, wherein the lock structure is positioned on the first hanger member.

18. A refrigerator including the storage system of claim 1 comprising:

a cabinet including at least one wall defining an interior area, wherein the storage system includes first hanger member configured to be attached with respect to the wall of the cabinet to support the first shelf within the interior area of the cabinet.

19. The refrigerator according to claim 18, wherein the first hanger member includes an interlocking device configured to be attached with respect to the wall at a selected elevation with the first hanger member acting as a cantilever support for the first shelf.

20. A storage system comprising:

a first shelf;

a drop-down shelf configured to be moved with respect to the first shelf between a deployed position and a collapsed position;

a first hanger member and a second hanger member, wherein the first hanger member supports a first side of the first shelf and the second hanger member supports a second side of the first shelf; and a first and a second linking guide linking the first shelf to the drop-down shelf, wherein the first and the second linking guide is adapted to allow selective positioning of the drop-down shelf with respect to the first shelf;

wherein the first shelf includes a first support surface and the drop-down shelf includes a second support surface, further wherein the first support surface and the second support surface are configured to remain substantially parallel with respect to one another as the drop-down shelf moves between the deployed position and the collapsed position;

further wherein the drop-down shelf is configured to be slidably attached to the first and the second linking guide adjacent to the first shelf.

21. The storage system of claim 20, wherein the first and the second linking guide comprises a first and second stationary track guide that each extend away from the first shelf, wherein at least one of the stationary track guides includes at least one trap for positioning the drop-down shelf in one of a plurality of alternative positions.

22. The storage system of claim 21, wherein the first hanger member is configured to support the first shelf, wherein the first and second stationary track guides are attached to the first hanger member.

23. The storage system of claim 21, wherein the first and the second linking guide further includes a third and fourth stationary track guide that each extend away from the first shelf.

24. The storage system of claim 23, wherein the drop-down shelf includes a first side and a second side with a width extending between the first and second sides, the first side includes a first support structure and a second support structure of the drop-down shelf, and the second side includes a third support structure and a fourth support structure, wherein the third support structure is slidably received in the third stationary track guide and the fourth support structure is slidably received in the fourth stationary track guide.

25. A refrigeration appliance including the storage system of claim 20 comprising:

a cabinet including at least one wall defining an interior area, wherein the storage system includes the first hanger member configured to be attached with respect to the wall of the cabinet to support the first shelf within the interior area of the cabinet.

26. The refrigeration appliance according to claim 25, wherein the first hanger member includes an interlocking device configured to be attached with respect to the wall at a selected elevation with the first hanger member acting as a cantilever support for the first shelf.

27. A storage system comprising:

a first shelf;

a drop-down shelf configured to be moved with respect to the first shelf;

a first link member slidably and pivotably attached with respect to the first shelf, and wherein the first link member is pivotably attached with respect to the drop-down shelf;

a second link member spaced from the first link member and slidably and pivotably attached with respect to the first shelf, and wherein the second link member is pivotably attached with respect to the drop-down shelf; and a lock structure including one or more protrusions straddling a portion of the first link member in a locked position.

* * * * *